US012747549B2

(12) United States Patent
Moore et al.

(10) Patent No.: US 12,747,549 B2
(45) Date of Patent: Sep. 29, 2026

(54) MODULAR EXPANSION JOINT SYSTEM

(71) Applicant: SIKA TECHNOLOGY AG, Baar (CH)

(72) Inventors: Gary Moore, Amherst, NY (US); Gregory Ross, Amherst, NY (US); Paul Pumm, Amherst, NY (US); Tom Buchanan, Amherst, NY (US)

(73) Assignee: SIKA TECHNOLOGY AG, Baar (CH)

( * ) Notice: Subject to any disclaimer, the term of this patent is extended or adjusted under 35 U.S.C. 154(b) by 254 days.

(21) Appl. No.: 18/382,713

(22) Filed: Oct. 23, 2023

(65) Prior Publication Data

US 2024/0133133 A1 Apr. 25, 2024
US 2024/0229379 A9 Jul. 11, 2024

Related U.S. Application Data

(63) Continuation-in-part of application No. 17/972,376, filed on Oct. 24, 2022, now abandoned.

(51) Int. Cl.
*E01D 19/06* (2006.01)

(52) U.S. Cl.
CPC ..... *E01D 19/06* (2013.01)

(58) Field of Classification Search
CPC ..... E01D 19/06; E01D 19/062; E01C 11/04
See application file for complete search history.

(56) References Cited

U.S. PATENT DOCUMENTS

| | | | |
|---|---|---|---|
| 4,339,214 | A | 7/1982 | Puccio et al. |
| 7,395,570 | B2 | 7/2008 | Bradford et al. |
| 12,359,383 | B2 | 7/2025 | Hoffmann et al. |
| 2008/0148499 | A1 | 6/2008 | Bradfopd |

(Continued)

FOREIGN PATENT DOCUMENTS

| | | | |
|---|---|---|---|
| CN | 112942089 | A | 6/2021 |
| CN | 112376415 | B | 5/2022 |
| CN | 112942087 | B | 7/2022 |

(Continued)

OTHER PUBLICATIONS

Sep. 2, 2025 Office Action issued in U.S. Appl. No. 17/972,376.

*Primary Examiner* — Gary S Hartmann
(74) *Attorney, Agent, or Firm* — Oliff PLC

(57) ABSTRACT

A modular expansion joint system includes transverse vehicle load bearing members which are positioned in a gap defined between adjacent spaced-apart structural members, support members positioned below the transverse vehicle load bearing members and extending across the expansion joint gap between the adjacent structural members. Elastomeric seals that extend between adjacent transversely extending, spaced-apart, load bearing members, and between transversely extending, spaced-apart, load bearing members and edge beams or sections that are at least partially embedded within the structural members for controlling movement of the support members, and one or more non-elastomeric compressive members for controlling the spacing between the transverse vehicle load bearing members. The one or more non-elastomeric compressive members for controlling the distance between the transverse vehicle load bearing members includes at least one coil spring which, according to certain illustrative embodiments, maintains a substantially equal distance between transverse vehicle load bearing members.

30 Claims, 11 Drawing Sheets

(56) References Cited

U.S. PATENT DOCUMENTS

| | | | |
|---|---|---|---|
| 2024/0133133 | A1 | 4/2024 | Moore et al. |
| 2024/0229379 | A9 | 7/2024 | Moore et al. |

FOREIGN PATENT DOCUMENTS

| | | | |
|---|---|---|---|
| CN | 114717934 | A | 7/2022 |
| CN | 112709128 | B | 4/2023 |
| CN | 116575324 | A | 8/2023 |
| EP | 0 401 401 | A1 | 12/1990 |
| GB | 1 320 145 | A | 6/1973 |
| KR | 930006997 | B1 | 7/1993 |

MODULAR EXPANSION JOINT SYSTEM

TECHNICAL FIELD

The present disclosure relates to an expansion joint system for a gap defined between adjacent construction or structural members. The present disclosure more particularly relates to a modular expansion joint system for a gap defined between adjacent construction members in bridge, highway, and roadway constructions.

BACKGROUND

A gap is intentionally provided between adjacent concrete structures in bridge, highway, and roadway constructions for accommodating dimensional changes within the gap occurring as expansion and contraction due to temperature changes, shortening and creep caused by prestressing concrete, seismic cycling and vibration, deflections caused by live loads, and longitudinal forces caused by vehicular traffic. An expansion joint system is conventionally utilized to accommodate these movements in or around the gap and to provide a transition across the gap.

Bridge constructions are also subject to movements in response to occurrence of seismic events. This raises serious problems as the movements occurring during such seismic events are not predictable either with respect to the magnitude of the movements or with respect to the direction of the movements. In many instances bridges have become unusable for significant periods of time due to seismic movements as vehicular traffic cannot travel across damaged expansion joints.

Modular expansion joint systems have been designed to accommodate larger magnitude movements occurring in multiple directions within or around the vicinity of an expansion joint gap defined between two adjacent structural members, for example, concrete or steel structural members. Modular expansion joint systems generally include a number of elongated vehicle load-bearing members, often referred to in the art as "center beams" or "center beam members," which have at least some component of their direction extending transversely to the direction of traffic traveling across the expansion joint gap, support bar members positioned below the center beams and extending in the direction of traffic across the expansion joint gap (ie, in the longitudinal direction, substantially perpendicular to the center beams) and support housings to support opposite ends of the support bars. The vehicle load bearing center beams are usually movably engaged with the support bar members through an engagement member. The elongated support bar members support the load bearing members. Each end of the support bar members is received in a housing embedded in the adjacent concrete structural members. Elastomeric seals extend between the load bearing members adjacent the tops of the load bearing members to fill the spaces between the load bearing members. These seals are flexible are therefore stretch and contract in response to movement of the load bearing members.

Molded elastomeric foam components have been typically used in modular expansion joint systems facilitate installation of the expansion joint system, to eliminate steel-steel contact, and to dampen shock and vibration occurring within the modular expansion joint. The molded elastomeric foam components were also designed to provide distance control between the vehicle load bearing center beam members of the modular expansion joint system. However, such elastomeric foam material deteriorates over the life cycle of the modular expansion joint system resulting in diminished performance and requiring tedious and expensive repairs.

Therefore, a need still exists in the art for a modular expansion joint system that can accommodate large magnitude movements that occur in multiple directions in or around the vicinity of the expansion joint gap, and which exhibits improved distance control between the vehicle load bearing members that does not decline over the intended life cycle of the expansion joint system.

SUMMARY

Disclosed is a modular expansion joint system for bridge, highway, and roadway constructions having improved distance control between adjacent vehicle load bearing members.

According to a first illustrative aspect, provided is a modular expansion joint system for a gap defined between spaced-apart first and second structural members and extending across said gap to permit pedestrian or vehicular traffic across said gap, the modular expansion joint system comprising a plurality of elongated transversely extending, spaced-apart, load bearing members; a plurality of elongated support members having opposite first and second ends extending longitudinally across said gap from said first structural member to said second structural member, wherein said plurality of elongated support members are positioned below said transversely extending, spaced-apart, load bearing members; at least one first means for accepting said first end of said at least one longitudinally extending elongated support member; at least one second means for accepting said second end of said at least one longitudinally extending elongated support member; and at least one non-elastomeric compressive member connected to adjacent elongated transversely extending, spaced-apart, load bearing members for controlling the spacing between said adjacent load bearing members.

According to a second illustrative aspect, provided is a modular expansion joint system for a gap defined between spaced-apart first and second highway or roadway structural members and extending across said gap to permit pedestrian or vehicular traffic across said gap, the modular expansion joint system comprising a plurality of elongated transversely extending, spaced-apart, load bearing members; a plurality of elongated support members having opposite first and second ends extending longitudinally across said gap from said first structural member to said second structural member, wherein said plurality of elongated support members are positioned below said transversely extending, spaced-apart, load bearing members; at least one first means for accepting said first end of said at least one longitudinally extending elongated support member; at least one second means for accepting said second end of said at least one longitudinally extending elongated support member; and at least one non-elastomeric compressive member connected to adjacent elongated transversely extending, spaced-apart, load bearing members for controlling the spacing between said adjacent load bearing members.

According to a third illustrative aspect, provided is a modular expansion joint system for a gap defined between spaced-apart first and second bridge structural members and extending across said gap to permit pedestrian or vehicular traffic across said gap, the modular expansion joint system comprising a plurality of elongated transversely extending, spaced-apart, load bearing members; a plurality of elongated support members having opposite first and second ends extending longitudinally across said gap from said first structural member to said second structural member, wherein said plurality of elongated support members are positioned below said transversely extending, spaced-apart, load bearing members; at least one first means for accepting said first end of said at least one longitudinally extending elongated support member; at least one second means for accepting said second end of said at least one longitudinally extending elongated support member; and at least one non-elastomeric compressive member connected to adjacent elongated transversely extending, spaced-apart, load bearing members for controlling the spacing between said adjacent load bearing members.

DETAILED DESCRIPTION OF ILLUSTRATIVE EMBODIMENTS

Figure 1:
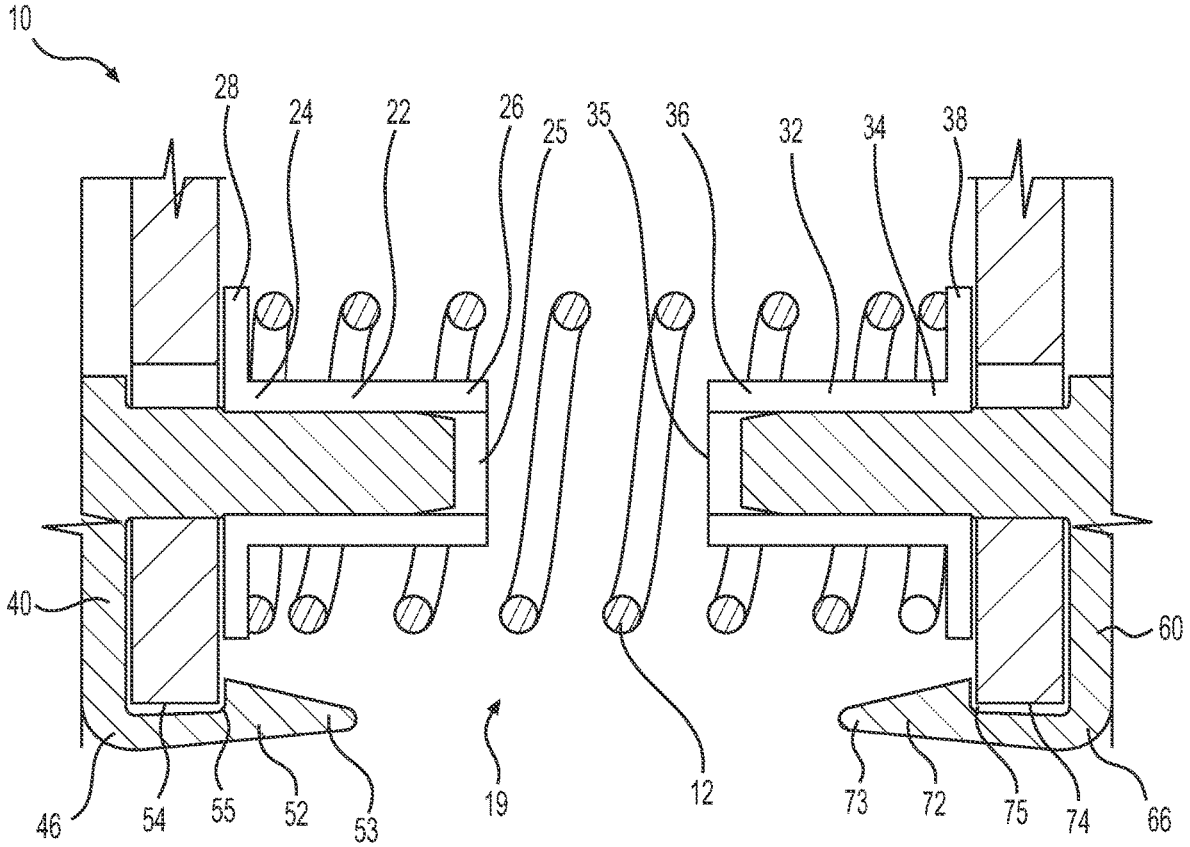
FIG. 1 is a cross-sectional view of an illustrative embodiment of the non-elastomeric compressive member comprising a coil spring assembly of the present disclosure.

Disclosed is a modular expansion joint system for a gap that is intentionally or otherwise purposefully defined between adjacent first and second structural members. The modular expansion joint system includes one or more non-elastomeric compressive members for controlling the distance between the vehicle load bearing beam members of the system. According to certain illustrative embodiments, the one or more non-elastomeric compressive members are configured for maintaining substantially equal distances between the vehicle load bearing beam members of the system. According to other illustrative embodiments, the one or more non-elastomeric compressive members are configured for maintaining equal distances between the vehicle load bearing beam members of the system.

The modular expansion joint system is positioned within the expansion joint gap and extends across the gap to permit pedestrian or vehicular traffic across the gap. The modular expansion joint system comprises a plurality of elongated and spaced-apart load bearing members that extend in a direction that is transverse (ie, the load bearing members have at least some component of their direction that is perpendicular to the direction of the vehicular traffic crossing the expansion joint gap). Each of the plurality of transversely extending, spaced-apart, load bearing members comprises top surfaces and bottom surfaces, and top surfaces of each of the transversely extending, spaced-apart, load bearing members are adapted to support vehicular traffic.

The modular expansion joint system also comprises a plurality of elongated support members that are positioned within the expansion joint gap below the transversely extending vehicle load bearing members. The elongated support members comprise opposite first and second ends and the elongated support members extend longitudinally (ie, in the direction of the vehicular traffic crossing the expansion joint gap) across the expansion joint gap from a first structural member to a second structural member.

The modular expansion joint system further comprises at least one first means for accepting a first end of a longitudinally extending elongated support member. The first means for accepting a first end of a longitudinally extending elongated support member is at least partially embedded within a first structural of an expansion joint.

The modular expansion joint system further comprises at least one second means for accepting a second end of a longitudinally extending elongated support member. The second means for accepting a second end of a longitudinally extending elongated support member is at least partially embedded within a second structural of an expansion joint across from the first structural member of a expansion joint gap.

According to certain illustrative embodiments, the modular expansion joint system comprises a plurality of support bar members that are positioned below the vehicle load bearing members and extend longitudinally across the expansion joint gap from a first structural member to a second structural member adjacent to the gap. There are a plurality of means for accepting the first ends of a longitudinally extending support bar member at least partially embedded within a first structural member adjacent an expansion joint gap. There are a plurality of means for accepting the second ends of a longitudinally extending support bar member at least partially embedded within a second structural member adjacent an expansion joint gap across the gap from the first structural member. Each of the plurality of longitudinally extending support bar members extend across the expansion joint gap along a longitudinal axis and have a first end supported within a first means for accepting embedded in the first structural member and a second end supported within a second means for accepting embedded in the second structural member.

The structure defining the first and second means for accepting the first and second ends of the longitudinally extending elongated support members may be selected from a box, receptacle, chamber, housing, container, enclosure, channel, track, slot, groove, or passage.

The modular expansion joint system further comprises means for movably engaging the longitudinally extending elongated support members with the transversely extending, spaced-apart vehicle load bearing members. According to certain illustrative embodiments, the means for movably engaging the longitudinally extending elongated support members with the transversely extending, spaced-apart vehicle load bearing members comprises a yoke. Without limitation, the yoke may comprise a continuous substantially U-shaped structure. According to other illustrative embodiments, the yoke may comprise spaced-apart yoke side plates and a bent yoke plate that spans the gap between the spaced-apart yoke side plates. The yoke slidably engages the longitudinally extending, elongated support members with the transversely extending, spaced-apart load bearing members. The structure of the yoke permits repeated longitudinal and vertical movement of the longitudinally extending, elongated support members.

According to another illustrative embodiment, yoke comprises spaced-apart yoke side plates that are attached to and extend downwardly from the bottom surface of the transversely-extending vehicular load bearing beam. The yoke includes bent yoke side plates, each of which includes first leg portions, bend regions and second leg portions. Ends of the first leg portions of yoke side plates are connected to the bottom surface of vehicular load bearing beam. Without limitation, according to this illustrative embodiment, ends of the yoke side plates are connected to the bottom surface of the vehicular load bearing beam by a weld. The yoke further includes a horizontally-extending yoke plate. The horizontally extending yoke plate extends parallel or substantially parallel in relation to vehicular load-bearing beam and second leg portions of the yoke side plates. The horizontally-extending yoke plate is connected to yoke side plates by one or more mechanical fasteners that are passed through second leg portions of the yoke side plates and the horizontally-extending yoke plate. The upper and lower yoke hearings are compressed by connecting the horizontally-extending yoke plate to the bent yoke side plates. A longitudinally extending support bar passes through the yoke. The yoke assembly also includes an upper yoke bearing and lower yoke spring. The yoke utilizes the flexible upper bearing and lower yoke spring to minimize yoke tilt and optimizes the ability of the expansion joint system to absorb vehicular impact from traffic moving across the expansion joint system. Spring-loaded, liquid charged, air charged, or elastomeric cushioning means may be interchangeably used for upper yoke bearing and lower yoke spring. The yoke may further include one or more yoke side guides that are affixed, attached, or connected to, or are integral with, the inwardly-facing surfaces of first leg portions of yoke side plates.

According to another illustrative embodiment, the yoke comprises an integral member comprising first and second leg portions and a spanning portion extending between the leg portions. The term integral member refers to a single machined member. The first and second leg portions, together with the spanning portion, comprise a saddle-shape yoke. The first and second leg portions extend downwardly from the bottom surface of the transversely-extending vehicular load bearing beam. Ends of the leg portions of the yoke are connected to the bottom surface of vehicular load hearing beam. Without limitation, according to this illustrative embodiment, ends of the first and second leg portions are connected to the bottom surface of the vehicular load bearing beam by a weld. A longitudinally extending support bar passes through yoke. The yoke also includes an upper yoke bearing and lower yoke spring. The yoke utilizes a flexible upper bearing and lower yoke spring to minimize yoke tilt and optimizes the ability of the expansion joint system to absorb vehicular impact from traffic moving across the expansion joint system. Spring-loaded, liquid Charged, air charged, or elastomeric cushioning means may be interchangeably used for upper yoke hearing and lower yoke spring. The yoke further includes yoke side guides that are affixed, attached, or connected to, or are integral with, inwardly-facing surfaces of leg portions of the yoke. According to certain embodiments, the thickness of the at least a portion of the spanning portion of the yoke is greater than the thickness of the first and second leg portions of the yoke. The required strength of the first and second leg portions of the yoke is less than the spanning region of the yoke. This permits the first and second leg portions of the yoke to possess a thickness that is less than the thickness of the spanning portion of the yoke. The thinner first and second leg portions of the yoke result in less welding time and material to connect ends of the first and second leg portions to the bottom surface of a transversely-extending vehicular load hearing member. According to certain embodiments, the yoke may include thickness transition regions where the thickness of the first and second leg portions transitions from the thickness of the first and second leg portions to the increased thickness of the spanning portion of the yoke.

The modular expansion joint system further comprises means for controlling the distance or spacing of the plurality of transversely extending vehicle load bearing members. The means for controlling the distance or spacing of the plurality of transversely extending vehicle load bearing members comprises one or more non-elastomeric compressive members. The one or more non-elastomeric compressive members are connected to or otherwise engaged the vehicle load bearing members. According to certain embodiments, the non-elastomeric compressive member is part of an assembly which has additional components configured to protect the non-elastomeric compressive member from the environment and to connect or otherwise engage the non-elastomeric compressive member with the vehicle load bearing beam members. According to certain illustrative embodiments, the non-elastomeric compressive member assembly is connected to adjacent transversely extending, spaced-apart, load bearing members to control the spacing between said adjacent load bearing members.

According to certain non-limiting illustrative embodiments, the one or more non-elastomeric compressive members comprise more or more compression springs. According to certain embodiments, the compression spring is part of a compression spring assembly having additional components configured to protect the compression spring from the environment and to connect or otherwise engage the compression spring with the vehicle load bearing beam members.

The compression spring assembly of the modular expansion joint system comprises an elongated compression spring. The elongated compression spring of the compression spring assembly comprises a helical or spiral compression spring. The helical compression spring of the compression spring assembly may be manufactured from a wide variety of non-limiting of materials so long as a non-elastomeric compressive member is attained. Without limitation and only by way of illustration the compression spring may be manufactured from alloy spring steels, stainless spring steels, carbon spring steels, oil-tempered carbon spring steels, hard drawn carbon spring steels, copper-based steel alloys and nickel-based steel alloys.

According to certain embodiments, the compression spring of the compression spring assembly further comprising a protective layer surrounding, or applied about or around, at least a portion of said elongated compression spring. According to certain embodiments, the protective layer comprises a coating, sleeve, or wrap. According to certain embodiments, the protective layer comprises a coating. According to some embodiments, the protective coating comprises a powder coating. Without limitation, and only by way of illustration, the coating comprises a corrosion-resistant powder coating.

The compression spring assembly further includes first and second tubular members engaged with the elongated compression spring. The first and second tubular members are configured to be at least partially inserted into the compression spring to engage the elongated compression spring to first and second spring clips and to provide vibration dampening to the system.

The first tubular member comprises an elongated tubular portion that is configured to be at least partially inserted or otherwise positioned within the first end of the compression spring assembly. The first tubular member comprises opposite first and second ends, an outer wall, and a hollow interior that is configured to engage with a first spring clip of the compression spring assembly. The compression spring assembly further includes a second tubular member comprising an elongated tubular portion that is configured to be at least partially inserted or positioned within the second end of the compression spring of the compression spring assembly. The second tubular member comprises opposite first and second ends, an outer wall, and a hollow interior that is configured to engage with a second spring clip component of the compression spring assembly.

According to certain embodiments, the either or both the first and second tubular members further comprise a flange at the first end of the tubular member. The flange comprises opposite facing first and second surfaces and an opening that is in communication with hollow interior of the elongated tubular portion of the tubular member. Without limitation, the flange is substantially planar and the hollow tubular portion of the tubular member extends perpendicularly from the second surface of the flange.

According to certain embodiments, the hollow tubular portion of the tubular member is circular with an outer circumference, and a cross-section taken along a short axis of the hollow portion of the tubular portion of the tubular member, is circular with a circumference concentric with the outer circumference of the flange of the tubular member. The outer circumference of the flange portion of the tubular member is greater than the circumference of the opening of the flange portion and the opening of the first end of the tubular portion of the tubular member. The circumference of the opening of the flange of the tubular member is substantially coextensive with the circumference of the opening of the tubular portion of the tubular member.

It should be noted that the first and second tubular members of the compression spring assembly are but one illustrative structure to engage the elongated compression spring with the compression spring clips. Any suitable structure or geometry of structure may be used so long as it is configured to engage or otherwise connect the elongated compression spring to the spring clips, which, in turn, connect the compression spring assembly to the vehicle load bearing beam members, and is configured to provide vibration dampening.

The compression spring assembly of the modular expansion joint system further comprises first and second spring clip members. Each of the first and second spring clip members of the compression spring assembly comprise a base portion or base segment and an elongated protrusion emanating from a surface of the base portion. The base portion of the first and second compression spring clips includes a bend portion that terminates in a tab. The bend portion of the spring clips includes a depressed or recessed region formed in the clip and the terminal tab. The tab includes an abutment surface or abutment wall adjacent the recessed region that is configured to act as an interference surface to maintain a portion of the connection member locked in the recessed region. The tab located at the terminal end of the bend portion of the base portion of the first and second spring clips acts a locking tab for connecting or otherwise engaging the compression spring assembly to the connection members of the vehicle load bearing members. An elongated protrusion emanates from a surface of the base portion and extends away from a surface of the base portion in a substantially horizontal manner. According to certain embodiments, the bend portion of the base portion of the first and second compression spring clips and the protrusion are configured in spaced apart parallel manner. The bend portion and the projection extend in substantially the same direction. According to certain embodiments, the bend portion and protrusion of the first and second spring clips extend in substantially the same direction and in the same vertical plane.

According to certain embodiments, the means for controlling the distance between the vehicle load bearing members are connected to adjacent vehicle load bearing members through a connection member. According to certain embodiments, the connection members are rigidly connected to the bottom surfaces of the vehicle load bearing members. The connection members extend downwardly from the bottom surface of the load bearing members in a vertical or substantially vertical manner. According to certain embodiments, the connection members are configured in a substantially planar, elongated bar shape. The planar connection members have opposite facing first and second connection member surfaces and a thickness extending between the first and second connection member surfaces. According to certain embodiments, each of the connection members comprise an opening that communicates through the entire thickness of the connection member. According to certain embodiments, the opening comprises a substantially circular opening having a circumference large enough to accept the protrusion of the base portion of the compression spring assembly. The compression spring assembly is connected to the vehicle load bearing members by passing the protrusion of the base of the first compression spring clip through the opening of a first connection member and the opening of the flange of the first tubular member, and the protrusion is inserted into the tubular portion of the first tubular member of the compression spring assembly. Likewise, the protrusion of the base of the second compression spring clip is passed through the opening of a second connection member and the opening of the flange of the second tubular member, and the protrusion is inserted into the tubular portion of the second tubular member of the compression spring assembly. An edge portion of a first load bearing member connection member is secured in the bend portion of the first compression spring clip by a depression formed in the bend portion and the terminal locking tab, and an edge portion of a second load bearing member connection member is secured in the bend portion of the second compression spring clip by a depression formed in the bend portion and the terminal locking tab. According to certain embodiments, the compression spring assembly is positioned below the transverse vehicle load bearing members and is attached downwardly from the bottom surfaces of adjacent vehicle load bearing members through the connection members. The compression spring assembly comprising compression spring is positioned below the vehicle load bearing members and extends horizontally between adjacent connection members.

The modular expansion joint further comprises elastomeric seals that extend between adjacent transversely extending, spaced-apart, load bearing members. According to certain embodiments, the modular expansion joint system comprises elastomeric seals that extend between adjacent transversely extending, spaced-apart, load bearing members, and between transversely extending, spaced-apart, load bearing members and edge beams or sections that are at least partially embedded within the first and second structural members adjacent the expansion joint gap.

Certain illustrative embodiments of the modular expansion joint system will now be described in greater with reference to the drawing FIGURES. It should be noted that the modular expansion joint system is not intended to be limited to the illustrative embodiments depicted in the drawing FIGURES, but shall include all variations and modifications that are within the scope of the claims.

Figure 2:
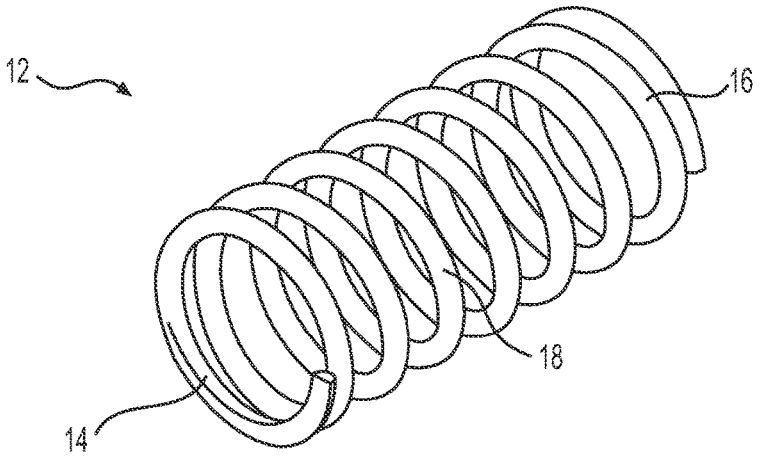
FIG. 2 is a perspective view of an illustrative embodiment of a compression spring useful in the compression spring assembly of the modular expansion joint.

FIGS. 1 and 2 discloses an illustrative embodiment of the compression spring assembly 10. Compression spring assembly 10 comprises an elongated coil spring 12 having a first end 14 and a second end 16. The compression spring 12 includes a plurality of helical turns 18 extending between the first end 14 and second end 16. Compression spring assembly 10 includes a protective layer 19 surrounding the compression spring 12 of the assembly 10.

Figure 3:
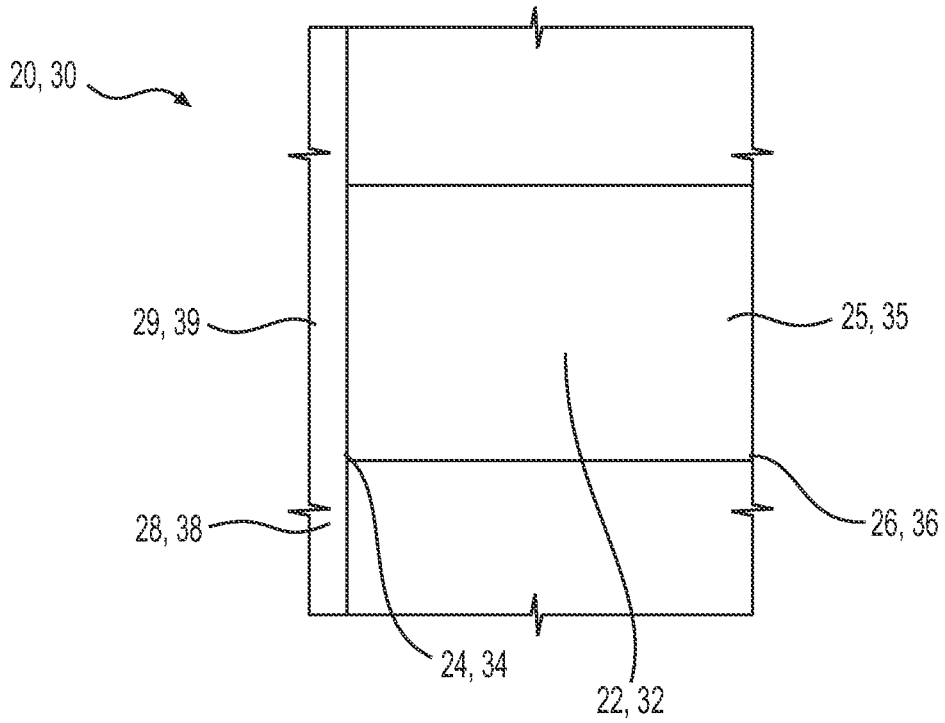
FIG. 3 is a side view of an illustrative embodiment of a tubular member useful in the compression spring assembly of the modular expansion joint.

Referring to FIGS. 1 and 3, compression spring assembly 10 further includes a first tubular member 20. First tubular member 20 includes an elongated hollow tubular portion 22 having a first tubular portion end 24, a second tubular portion end 26, and a hollow interior 25. A circular flange member 28 is located at the first tubular portion end 24 of the tubular portion 22 of the tubular member 20. The circular flange 28 includes an opening 29 that communicates with the hollow interior 25 of the tubular portion 22 of the first tubular member 20. Second tubular member 30 includes an elongated hollow tubular portion 32 having a first tubular portion end 34, a second tubular portion end 36, and a hollow interior 35. A circular flange member 38 is located at the first tubular portion end 34 of the tubular portion 32 of the tubular member 30. The circular flange 38 includes an opening 39 that communicates with the hollow interior 35 of the tubular portion 32 of the second tubular member 30.

Figure 4:
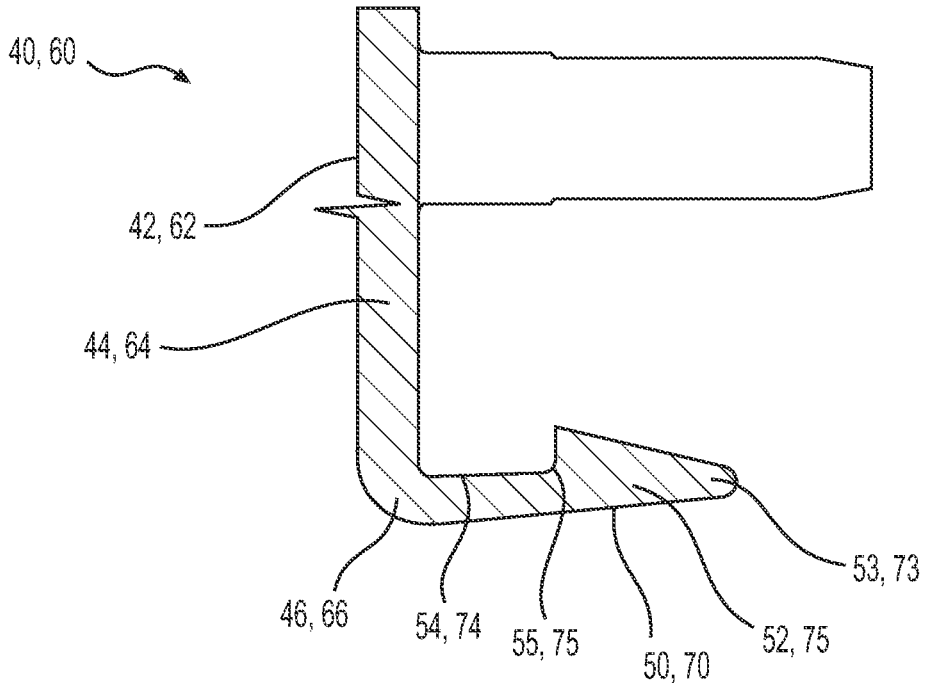
FIG. 4 is a side view of an illustrative embodiment of a spring clip useful in the compression spring assembly of the modular expansion joint.

Referring to FIGS. 1 and 4, the compression spring assembly 10 further comprises first compression spring clip member 40 and second compression spring clip member 60. First compression spring clip member 40 comprises a base portion or segment 42 having a straight portion 44 and a bend portion 46. First compression spring clip member 40 further includes an elongated projection 48 extending from the straight portion 44 of the base portion 42. The bend portion 46 of the first compression spring clip member 40 includes a recessed seat region 54 and a tab portion 50. The tab portion 50 includes a thickened portion 52 adjacent the recessed seat region 54, abutment wall 55, and a terminal tip 53.

Still referring to FIG. 1, second compression spring clip member 60 comprises a base portion or segment 62 having a straight portion 64 and a bend portion 66. Second compression spring clip member 60 further includes an elongated projection 68 extending from the straight portion 64 of the base portion 62. The bend portion 66 of the second compression spring clip member 60 includes a recessed seat region 74 and a tab portion 70. The tab portion 70 includes a thickened portion 72 adjacent the recessed seat region 74, abutment wall 75, and a terminal tip 73.

Figure 5A:
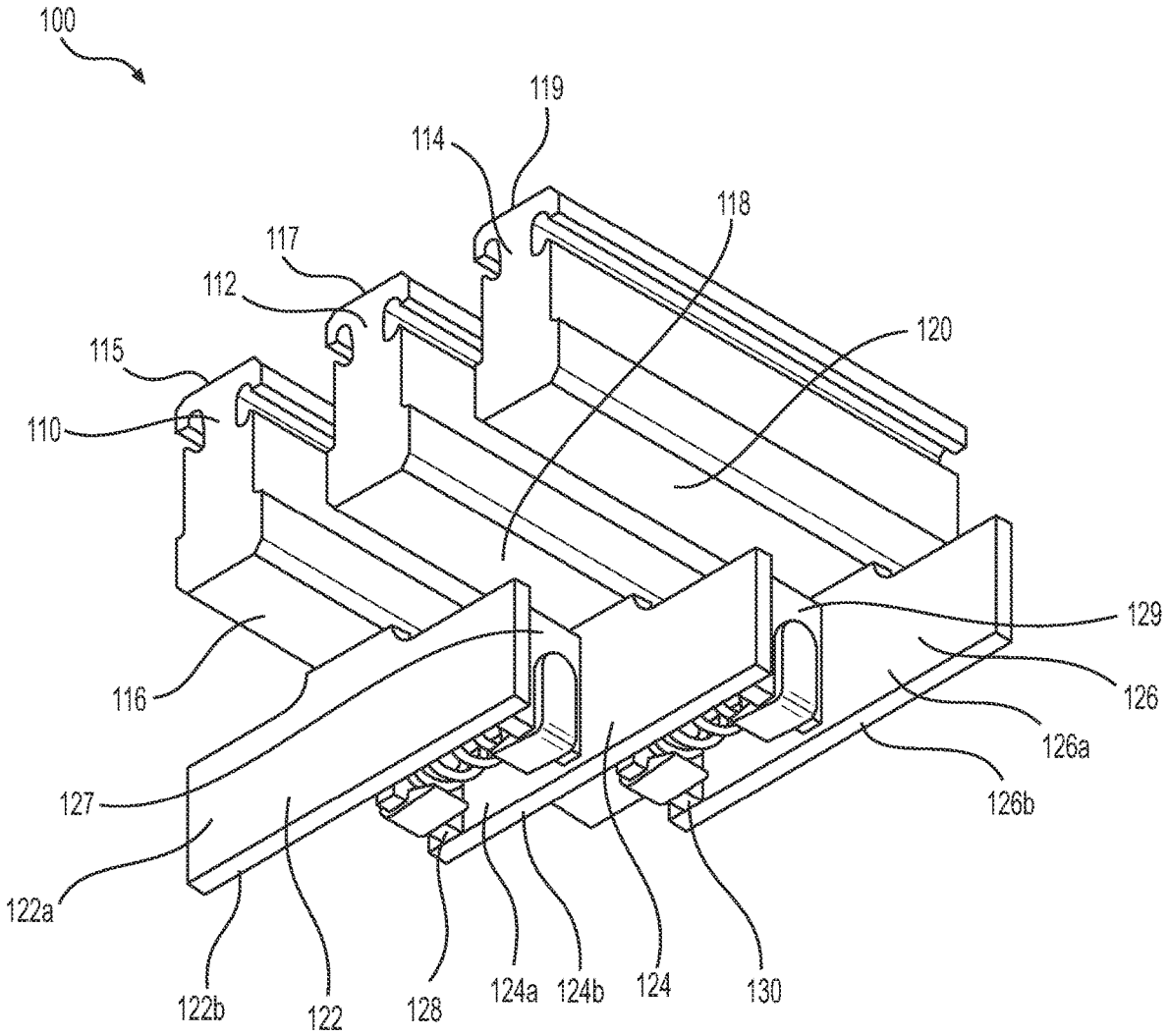
FIG. 5A is an iso-metric view of an illustrative embodiment of the equidistance system of the modular expansion joint.
Figure 5B:
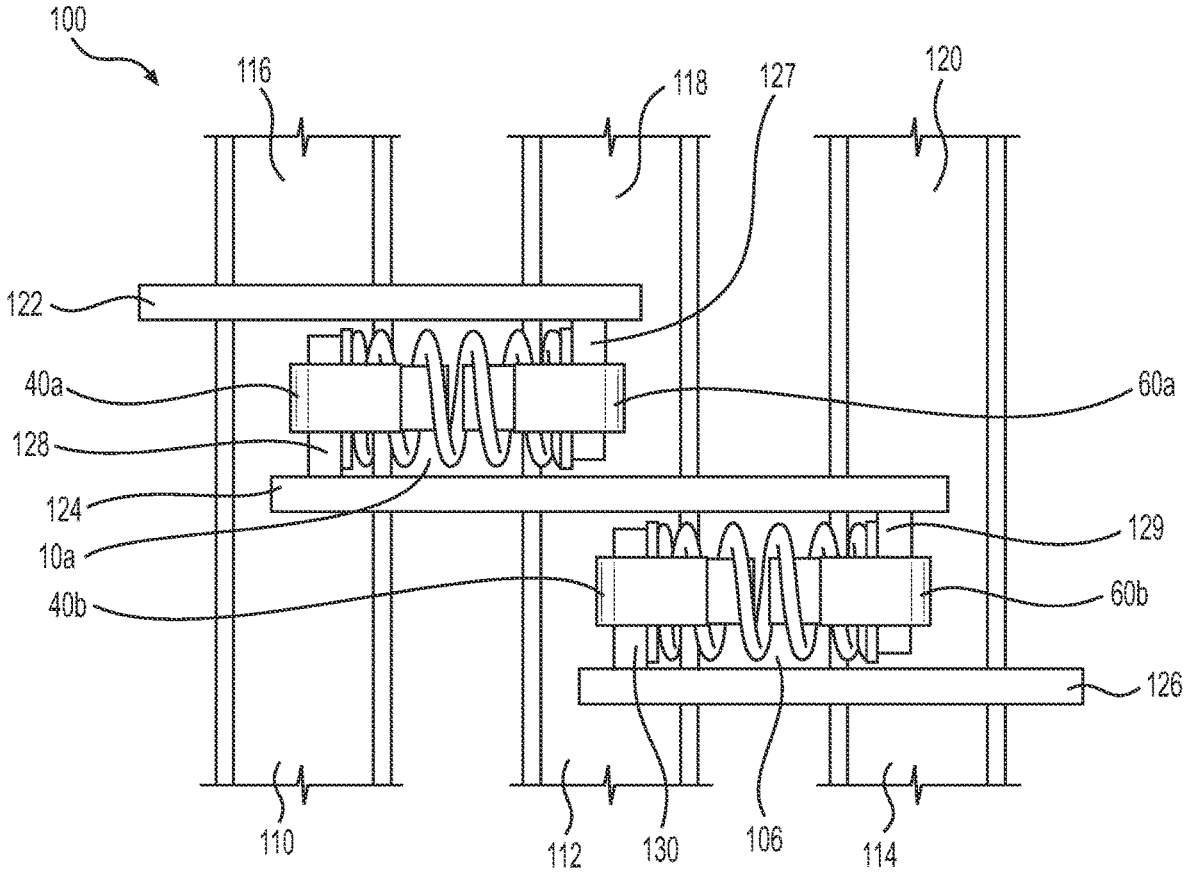
FIG. 5B is a bottom plan view of the illustrative embodiment of the equidistance system of the modular expansion joint of FIG. 5A.

FIGS. 5A and 5B show an embodiment of the modular expansion joint system 100. Modular expansion joint system 100 includes a plurality of vehicular load bearing members 110, 112, 114. The vehicular load bearing beam members 110, 112, 114 of the modular expansion joint system 100 are positioned in a side-by-side spaced apart relationship in the gap between the adjacent structural members, such as highway, roadway, or bridge structural members. According to certain embodiments, the load bearing beam members 110, 112, 114 have a generally square or rectangular cross section. It should be noted, however, that the load bearing beam members 110, 112, 114 are not limited to beam members having approximately square or rectangular cross sections, but, rather, the load bearing beam members 110, 112, 114 may comprise any number of cross-sectional configurations or shapes.

The vehicle load bearing members 110, 112, 114 are positioned in a side-by-side relationship and extend transversely in the expansion joint gap relative to the direction of vehicle travel across the expansion joint gap and modular expansion joint system 100. The top surfaces 115, 117, 119 of the load bearing beam members are adapted to support vehicle tires as a vehicle passes over the expansion joint. Compressible seals (not shown) are attached to the load bearing members 110, 112, 114 and extend transversely between the positioned vehicular load bearing beam members 110, 112, 114 adjacent the top surfaces 115, 117, 119 of the beam members 110, 112, 114 to fill the spaces between the beam members 110, 112, 114. The seals can also be positioned and extend in the space between edge members and adjacent vehicle load bearing beam members 110, 112, 114. The seals are flexible and compressible and, therefore, can stretch and contract in response to movement of the load bearing beams 110, 112, 114 within an expansion joint gap. By way of illustration and not limitation, the seals are made from a durable and abrasion resistant elastomeric material. The seal members are not limited to any particular type of seal. Suitable sealing members that can be used include, but are not limited to, strip seals, glandular seals, and membrane seals.

Still referring to FIGS. 5A and 5B, connection members 122, 124, 126 are attached to the bottom surfaces 116, 118, 120 of vehicle load bearing members 110, 112, 114. Connection members 122, 124, 126 are attached to the bottom surfaces 116, 118, 120 of vehicle load bearing members 110, 112, 114 in a substantially perpendicular arrangement relative to the vehicle load bearing members 110, 112, 114. The connection members 122, 124, 126 are depicted as elongated connection plates. However, it should be noted that the connection members are not limited to the geometry of plate and can be any suitable geometry that is configured to be attached to the vehicle load bearing members 110, 112, 114 and is configured to connect the non-elastomeric compressive member to the vehicle load bearing members 110, 112, 114.

Connection member 122 includes opposite facing first 122*a* and second 122*b* major surfaces. Connection member 124 includes opposite facing first 124*a* and second 124*b* major surfaces. Connection member 126 includes opposite facing first 126*a* and second 126*b* major surfaces. Tab 127 is connected to connection member 122 and extends substantially perpendicularly from second surface 122*b* of connection member 122. Tab 128 is connected to connection member 124 and extends substantially perpendicularly surface 124*a* of connection member 124. Tab 129 is connected to connection member 124 and extends substantially perpendicularly from surface 124*b* of connection member 124. Tab 130 is connected to connection member 126 and extends substantially perpendicularly from surface 126*a* of connection member 126. Tab members 127, 128 extend between surface 122*b* of connection member 122 and surface 124*a* of connection member 124. Tab members 129, 130 extend between surface 124*b* of connection member 124 and surface 126*a* of connection member 126. A first compression spring assembly 10*a* is connected to vehicle load bearing beams 116, 118. Compression spring assembly clip 40*a* connects with tab member 128 and compression spring assembly clip 60*a* connects with tab member 127 to connect spring assembly 10*a* between beam members 116, 118. A second compression spring assembly 10*b* is connected to vehicle load bearing beams 118, 120. Compression spring assembly clip 40*b* connects with tab member 130 and compression spring assembly clip 60*b* connects with tab member 129 to connect spring assembly 10*b* between beam members 118, 120.

Figure 6A:
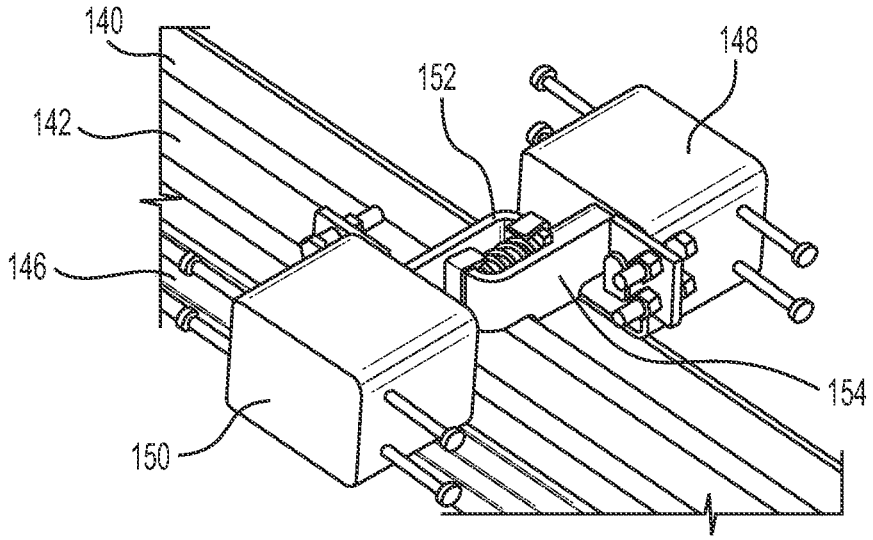
FIG. 6A is an iso-metric view of another illustrative embodiment of the equidistance system of the modular expansion joint.
Figure 6B:
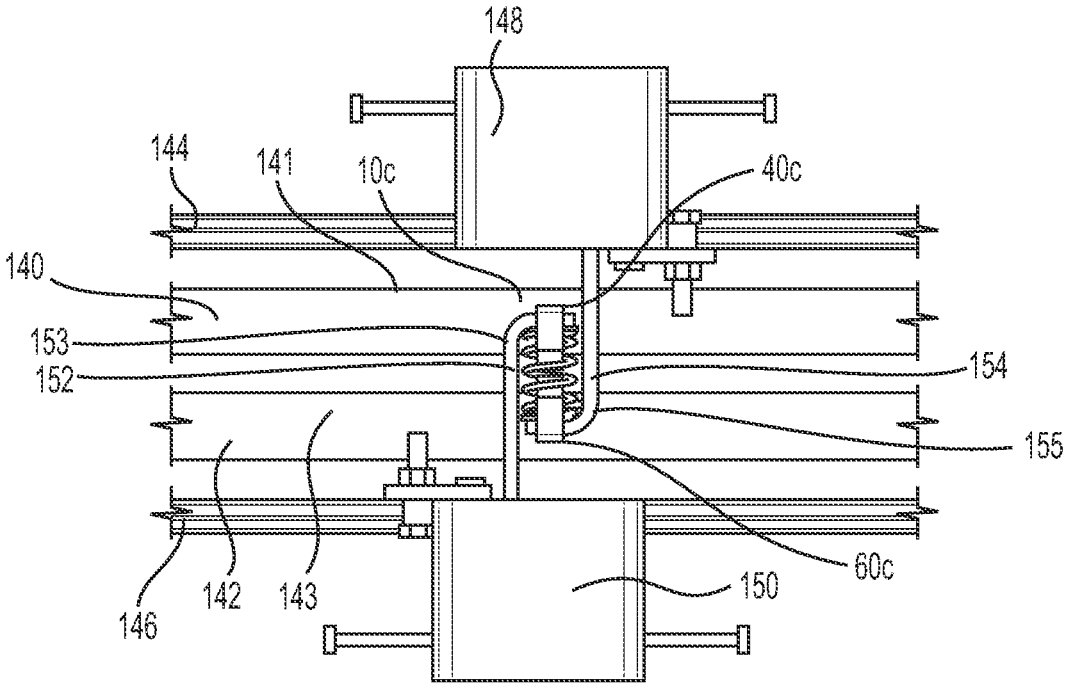
FIG. 6B is a bottom plan view of the illustrative embodiment of the equidistance system of the modular expansion joint of FIG. 6A.

FIGS. 6A and 6B show iso-metric and bottom plan views of another illustrative embodiment of the modular expansion joint system. According to this embodiment, the modular expansion joint system includes vehicular load bearing beam members 140, 142 positioned between edge members 144, 146. Connection member 152 extends from support box 150 and bend portion 153 of connection member 152 is connected to the bottom surface 141 of vehicle load bearing beam member 140. Connection member 154 extends from the opposite longitudinal side of the modular expansion joint system and from support box 148. Bend portion 155 of connection member 154 is connected to the bottom surface 143 of vehicle load bearing beam member 142. Compression spring assembly 10*c* is connected between vehicle load bearing beam members 140, 142 by engaging spring assembly clip 40*c* to the bend portion 153 of connection member 152 and engaging spring assembly clip 60*c* to the bend portion 155 of connection member 154. While the illustrative embodiment depicted in FIGS. 6A and 6B show two vehicular load bearing beam members, any suitable number of vehicle load bearing beam members may be used depending on the given job design.

Figure 7:
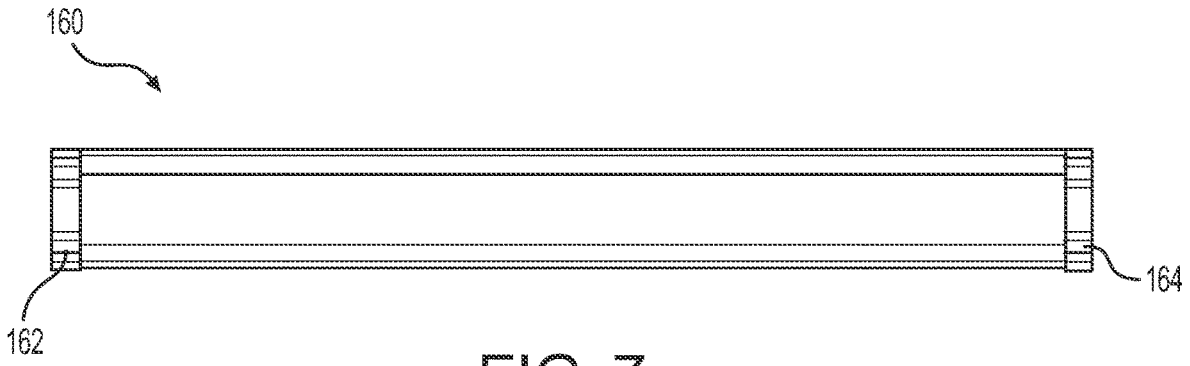
FIG. 7 is a side view of an illustrative embodiment of a support bar member of the modular expansion joint system of the present disclosure.

Referring to FIG. 7, modular expansion joint system includes a plurality of support bar members 160. Support bar members 160 are configured to be positioned in a spaced-apart, side-by-side relationship and extend longitudinally within the expansion joint gap. The term "longitudinally" as used in this specification means that the support bar members 160 extend substantially in the direction of vehicle travel across the expansion joint gap and modular expansion joint system from a first structural member to a second structural member adjacent an expansion joint gap. The support bar members 160 are positioned below the transversely extending vehicle load bearing members 110, 112, 114 and provide support to the vehicle load bearing beams 110, 112, 114 as vehicular traffic passes over the expansion joint gap and system. Support bar members 160 also accommodate longitudinal and vertical movement of the expansion joint system within the gap. Each end of the support bar members 160 are received into a suitable means for accepting the ends of the support bar members 160, and the several means for accepting the support bar members 160 are disposed, or embedded in the "block-out" regions of respective adjacent first and second structural members in a highway, roadway or bridge construction. The expansion joint system can be affixed within the block-out areas between two structural members by disposing the system into the gap between the structural members and pouring concrete or polymeric modified concrete into the block-out regions, or by mechanically affixing the expansion joint system in the gap to underlying structural support. Mechanical attachment may be accomplished, for example, by mechanically fastening or welding the expansion joint system to the underlying structural support. The support bar member 160 is shown as an elongated bar-like member having a square cross section. It should be noted, however, that the support bar member 160 is not limited to those elongated bar members having square cross sections, but, rather, the support bar member 160 may comprise an elongated bar member having a number of different cross-sectional shapes such as, for example, round, oval, oblong and rectangular. The support bar member 160 includes opposite first end 162 and second end 164.

Figure 8:
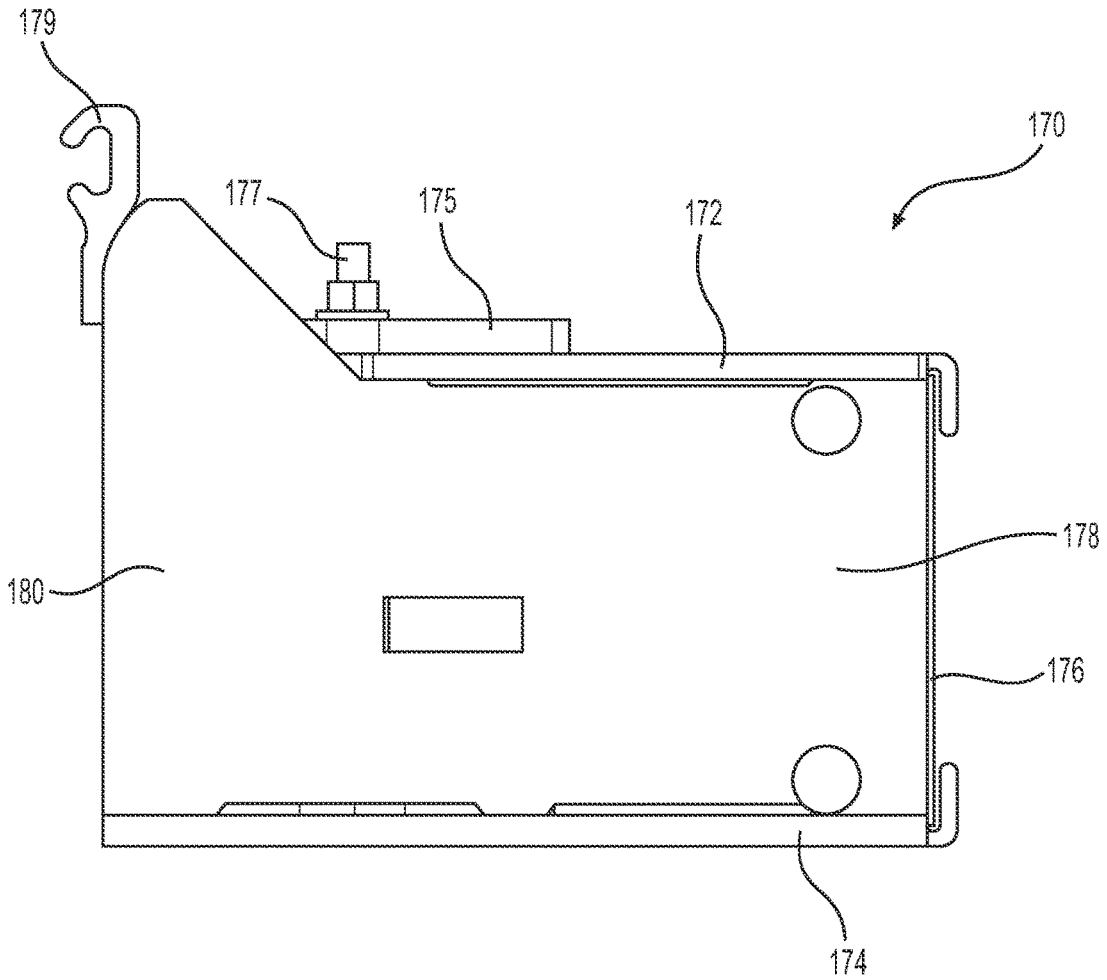
FIG. 8 is a side view of an illustrative embodiment of a support box of the modular expansion joint system of the present disclosure.

Referring to FIG. 8, the modular expansion joint system includes a plurality of boxes 170 for accepting or otherwise receiving the ends 162, 164 of the elongated support bar members 160. Boxes 170 for receiving the opposite ends of the support bars 160 are designed to permit longitudinal and vertical movement of the support bar members 160 within the boxes 170, while confining the support bar members 160 against relative transverse movement. According to certain illustrative embodiments, the support bar member boxes 170 comprises a box-like receptacle. It should be noted, however, that the longitudinal movement support bar boxes 170 may include any structure such as, for example, receptacles, chambers, housings, containers, enclosures, channels, tracks, slots, grooves, or passages, that includes a suitable cavity for accepting the end portions 162, 164 of the support bar members 160. Boxes 170 include top plate 172, bottom plate 174, rear plate 176 and side plates 178. Compression plate 175 is mechanically attached to the top plate 170 of support box 170 with mechanical fastener 177. Edge member 179 is connected to the front of support box 170. Boxes 170 have an open front 180 facing toward the expansion joint gap.

Figure 9A:
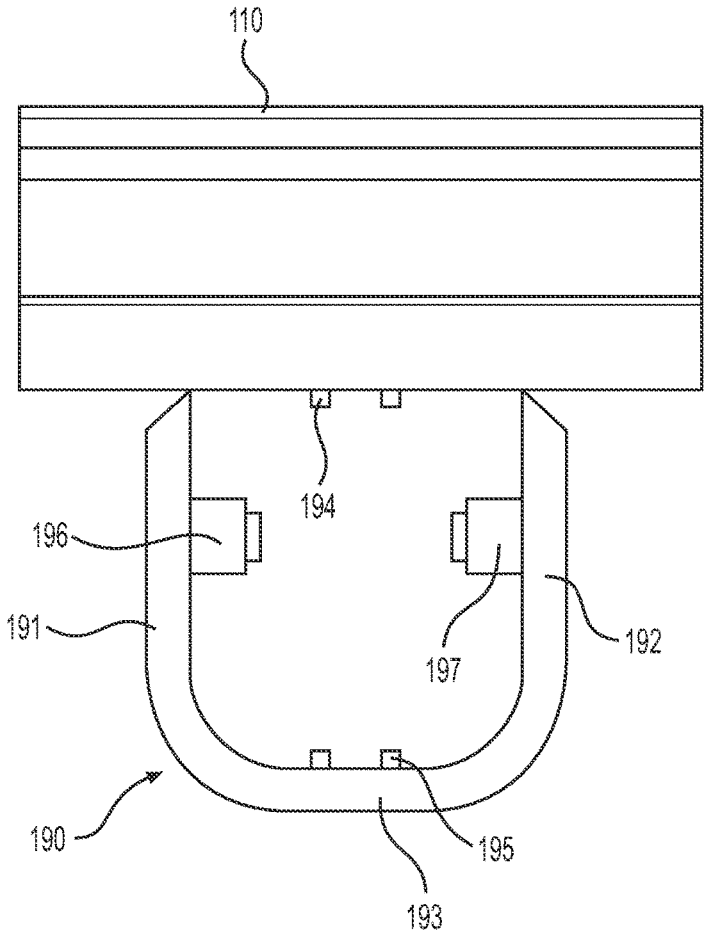
FIG. 9A is a side view of an illustrative embodiment of a yoke of the modular expansion joint system of the present disclosure.
Figure 9B:
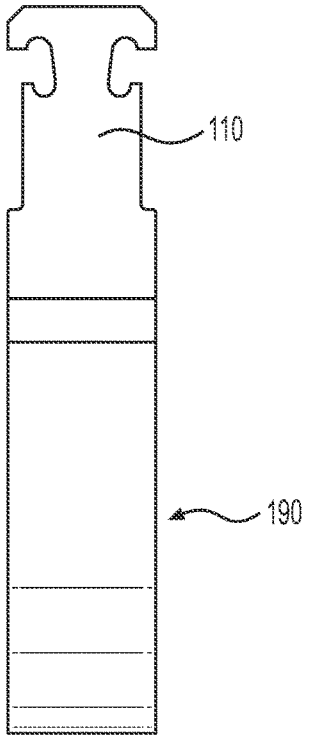
FIG. 9B is an end view of the illustrative embodiment of a yoke of the modular expansion joint system of FIG. 9A connected to a vehicle load bearing beam member.

Referring now to FIGS. 9A and 9B, means 190 is provided to maintain the position of support bar members 160 relative to the bottom surfaces of the load bearing beams members 110, 112, 114. Means 190 provide a mechanism which permits longitudinal and limited vertical movement of the support bar members 160 within the means 190. Shown in FIGS. 9A and 9B is one illustrative embodiment of the means 190 comprising a yoke or stirrup assembly for retaining the position of the support bar members 160 relative to the bottom surfaces of the load bearing beams 110, 112, 114 of the expansion joint system. The yoke assembly 190 comprises a single continuous saddle or U-shaped piece. Yoke 190 includes leg portions 191, 182 and spanning portion 193 that extends between legs 191, 192. The yoke assembly 190 also includes upper yoke bearings 194 and lower yoke bearings 195. The yoke assembly 190 utilize side 196, 197 yoke bearings to minimize yoke tilt and optimizes the ability of the expansion joint system to absorb vehicular impact from traffic moving across the expansion joint system. While the one embodiment is shown utilizing a yoke or stirrup assembly to maintain the positioning of the support bars 190, any restraining device or "hold-down" device or the like that can maintain the position of the support bars 160 relative to the load bearing beams 110, 112, 114, may be utilized.

Figure 10:
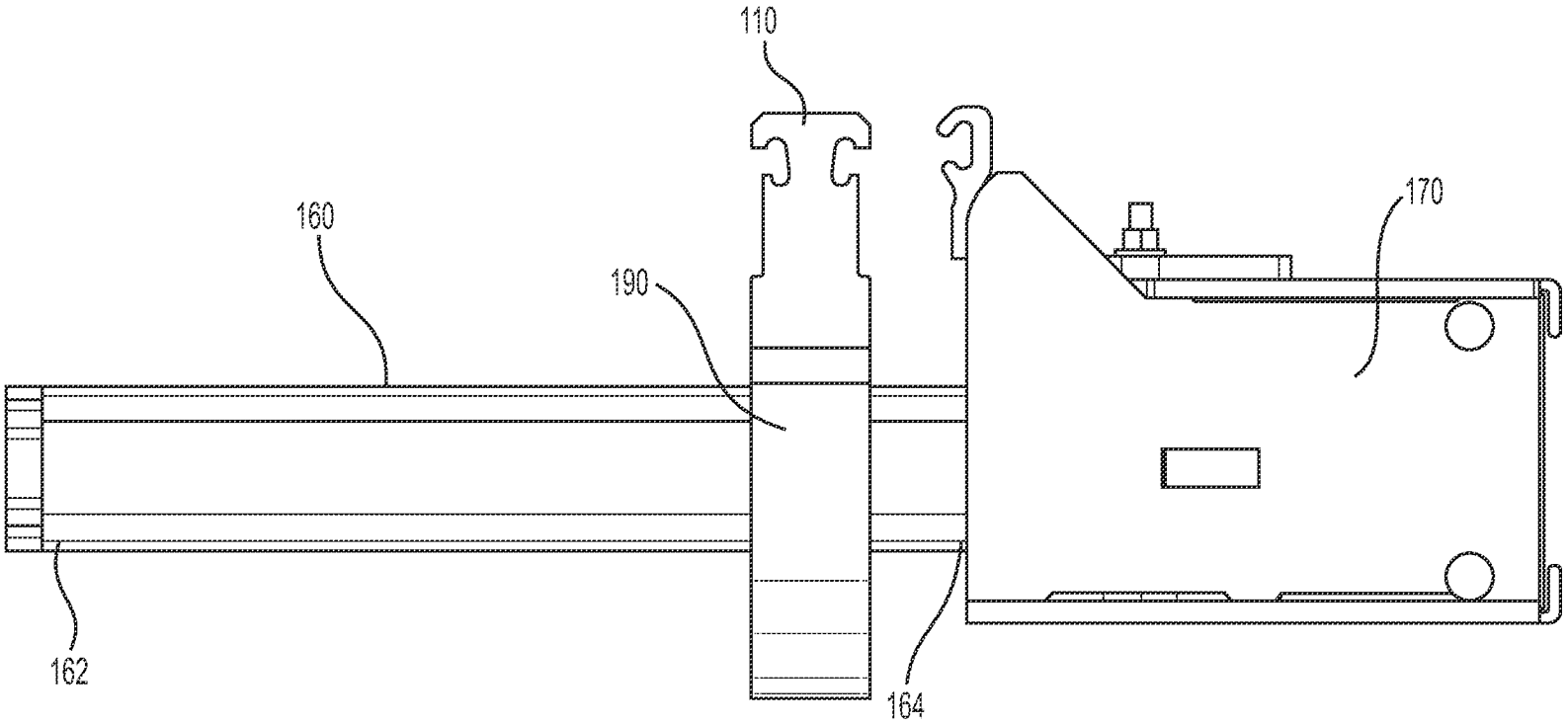
FIG. 10 is a side view of an illustrative embodiment of the modular expansion joint showing the vehicle lead bearing beam members, the elongated support bar member, a yoke and a support box for the support bar member.

FIG. 10 shows a side view of an illustrative embodiment of the modular expansion joint. Elongated support bar member 160 passes through yoke 190 and is inserted into the support box 170. End 164 of support bar member 160 is received into the opening 180 of support box 170, and the position of the top and bottom sides of the support bar member 160 may be maintained within boxes 170 by means for permitting longitudinal and vertical movement of the support bar members 160 within boxes 170 and means for substantially preventing transverse movement of the support bar members 160.

Figure 11:
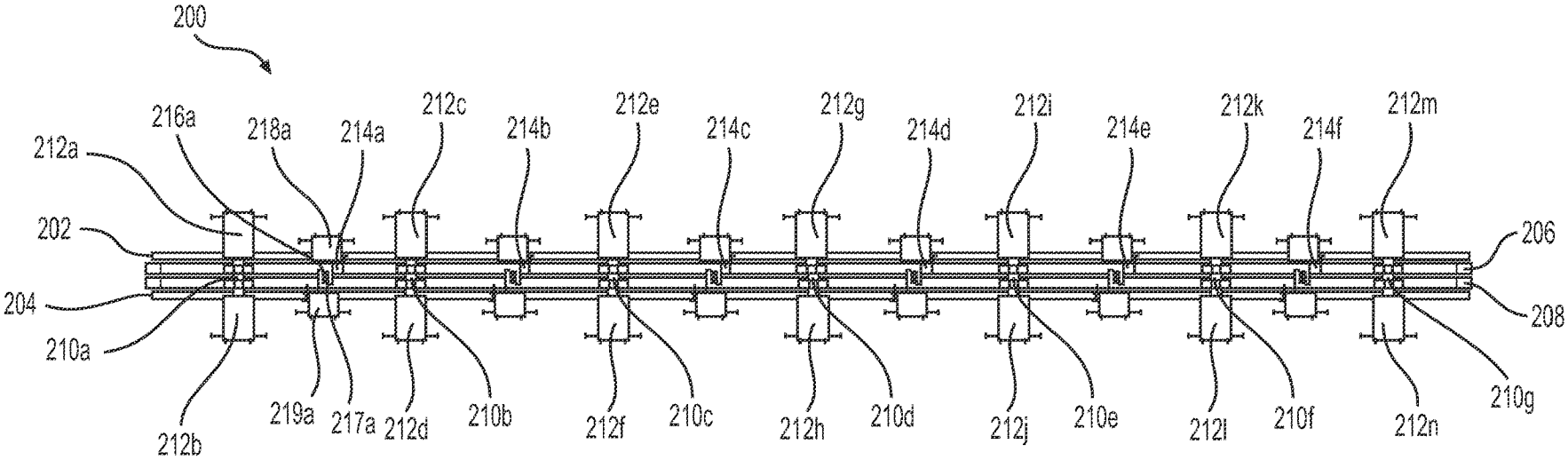
FIG. 11 is a bottom plan view of an illustrative embodiment of the modular expansion joint.

FIG. 11 shows a bottom plan view of an embodiment of the modular expansion joint system 200. System 200 includes edge members 202, 204 and vehicle load bearing beam members 206, 208. While the illustrative embodiment depicted in FIG. 11 shows two vehicular load bearing beam members, any suitable number of vehicle load bearing beam members may be used depending on the given job design. System 200 also includes a plurality of longitudinally extending support bar members 210*a*-210*g*. The opposite ends of the elongated support bar members 210*a*-210*g* are inserted into support boxes 212*a*-212*n* for the longitudinally extending support bar members 210*a*-210*g*. System 200 includes a plurality of equidistance control members 214*a*-214*f*, which are of the illustrative embodiment of FIGS. 6A and 6B. Connection members 216*a*-216*f* extend from support boxes 218*a*-218*f* and are connected to vehicle load bearing beam member 208. Connection members 217*a*-217*f* extend from support boxes 219*a*-219*f* and are connected to vehicle load bearing beam member 206. Equidistance control members 214*a*-214*f* are engaged with vehicle load bearing beam members 206, 208 by connection members 216*a*-216*f* and 217*a*-217*f*.

Figure 12:
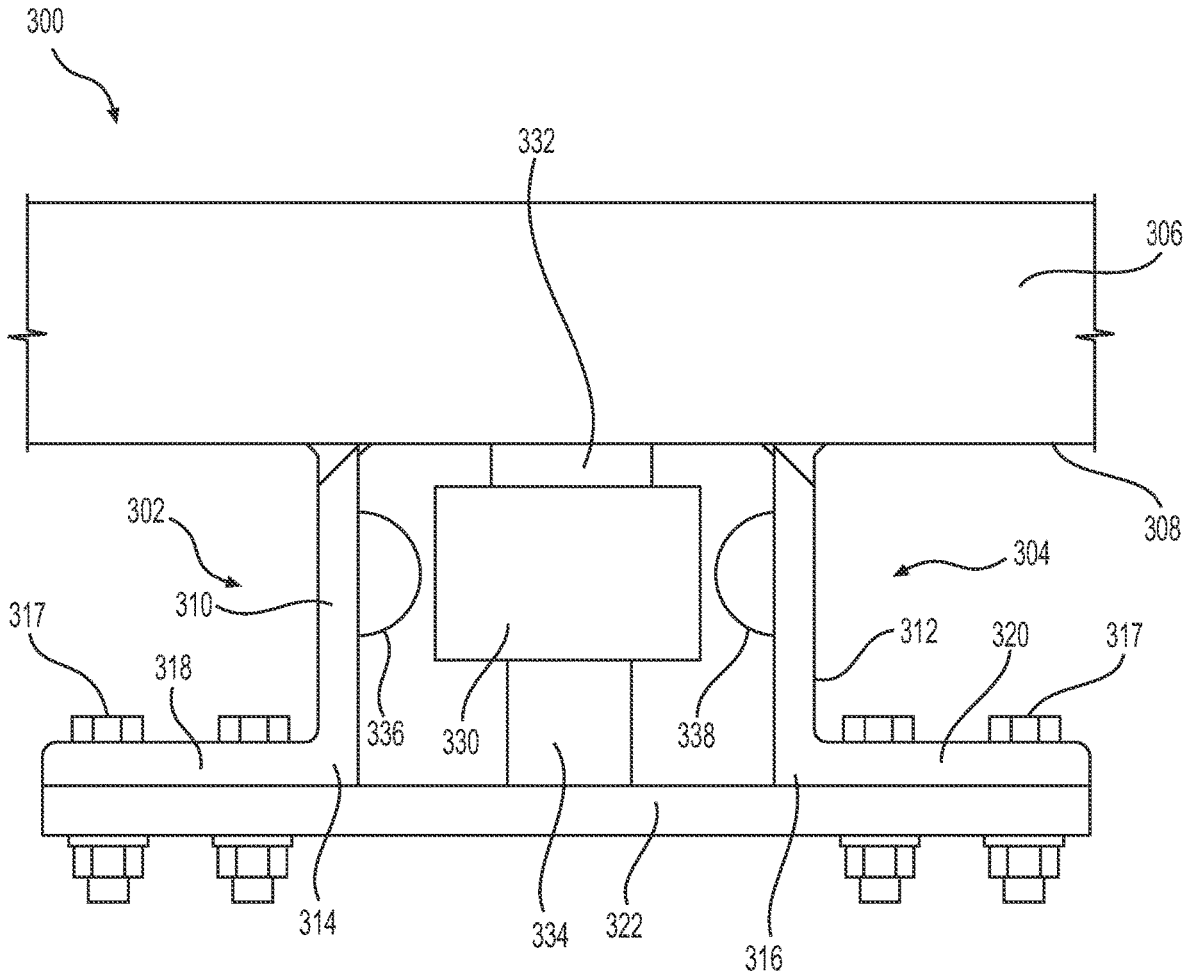
FIG. 12 is a side view of another illustrative embodiment of a yoke of the modular expansion joint system of the present disclosure.

FIG. 12 shows another illustrative embodiment of a yoke. Yoke 300 includes spaced-apart yoke side plates 302, 304 that are attached to and extend downwardly from the bottom surface 308 of the transversely-extending vehicular load bearing beam 306. Bent yoke side plates 302, 304 includes first leg portions 310, 312, bend regions 314, 316 and second leg portions 318, 320. Ends of the first leg portions 310, 312 of yoke side plates 302, 304 are connected to the bottom surface 308 of vehicular load bearing beam 306. Without limitation, according to this illustrative embodiment, the yoke side plates 302, 304 are connected to the bottom surface 308 of the vehicular load bearing beam 306 by a weld. Yoke 300 further includes horizontally-extending yoke plate 322. Horizontally-extending yoke plate 322 extends parallel or substantially parallel in relation to vehicular load-bearing beam 306 and second leg portions 318, 320. Horizontally-extending yoke plate 322 is connected to yoke side plates 302, 304 by mechanical fasteners 317 passed through second leg portions 318, 320 of side plates 302, 304 and yoke plate 322. Longitudinally extending support bar 330 passes through yoke 300. Yoke assembly 300 also includes an upper yoke bearing 332 and lower yoke spring 334. The yoke 300 utilizes flexible upper bearing 332 and lower yoke spring 334 to minimize yoke tilt and optimizes the ability of the expansion joint system to absorb vehicular impact from traffic moving across the expansion joint system. Yoke 300 further includes yoke side guides 336, 338 attached to inwardly-facing surfaces of first leg portions 310, 312 of yoke side plates 302, 304. While yoke side guides 336, 338 are shown as being hemispherical in shape, this is only illustrative and any geometric shape that guides the movement of the support bar 330 within the yoke 300 may be used.

Figure 13:
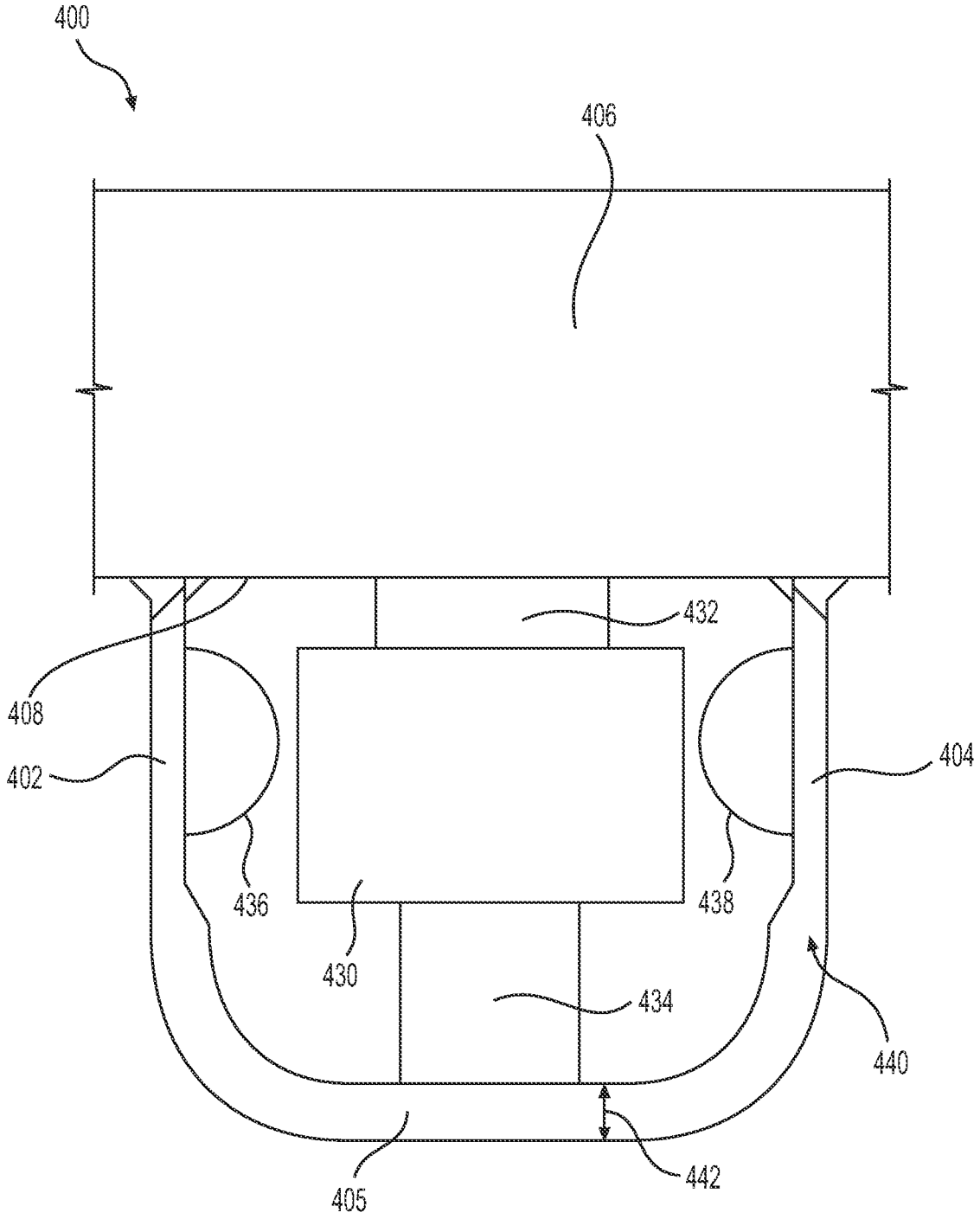
FIG. 13 is a side view of another illustrative embodiment of a yoke of the modular expansion joint system of the present disclosure.

FIG. 13 shows another illustrative embodiment of a yoke. Yoke 400 includes leg portions 402, 404 and spanning portion 405 extending between leg portions 402, 404. Leg portions 402, 404 and spanning portion 405 together constitute a single machined member. Leg portions 402, 404 extend downwardly from the bottom surface 408 of the transversely-extending vehicular load bearing beam 406. Ends of the leg portions 402, 404 of yoke 400 are connected to the bottom surface 408 of vehicular load bearing beam 406. Without limitation, according to this illustrative embodiment, the ends of legs 402, 404 are connected to the bottom surface 408 of the vehicular load bearing beam 406 by a weld. Longitudinally extending support bar 430 passes through yoke 400. Yoke assembly 400 also includes an upper yoke bearing 432 and lower yoke spring 434. The yoke 400 utilizes flexible upper bearing 432 and lower yoke spring 434 to minimize yoke tilt and optimizes the ability of the expansion joint system to absorb vehicular impact from traffic moving across the expansion joint system. Yoke 400 further includes yoke side guides 436, 438 attached to inwardly-facing surfaces of leg portions 402, 404 of yoke 400. While yoke side guides 436, 438 are shown as being hemispherical in shape, this is only illustrative and any geometric shape that guides the movement of the support bar 430 within the yoke 400 may b used. Leg portions 402, 404 have a thickness 440 that is less than the thickness 442 of spanning portion 405.

The expansion joint system is used in the gap between adjacent concrete roadway sections. The concrete is typically poured into the blockout portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

It is thus demonstrated that the present invention provides an improved expansion joint system that can accommodate expansion and contraction within an expansion joint that occurs in response to temperature changes, seismic cycling and deflections caused by vehicular loads. The expansion joint system maintains a substantially equal distance between the transversely disposed vehicular load bearing beams of the expansion joint system.

While the present embodiments have been described above in connection with illustrative embodiments, it is to be understood that other similar embodiments may be used or modifications and additions may be made to the disclosed embodiments for performing the same function of the expansion joint system without deviating therefrom. Further, all embodiments disclosed are not necessarily in the alternative, as the various illustrative embodiments of the disclosed expansion joint system may be combined to provide the desired characteristics. Variations can be made by one having ordinary skill in the art without departing from the spirit and scope of the disclosure. Therefore, the present disclosure should not be limited to any single embodiment, but rather construed in breadth and scope in accordance with the recitation of the attached claims.

We claim:

1. A modular expansion joint system for a gap defined between spaced-apart first and second structural members and extending across said gap to permit pedestrian or vehicular traffic across said gap, the modular expansion joint system comprising:

a plurality of elongated transversely extending, spaced-apart, load bearing members;

a plurality of elongated support members having opposite first and second ends extending longitudinally across said gap from said first structural member to said second structural member, wherein said plurality of elongated support members are positioned below said transversely extending, spaced-apart, load bearing members;

at least one first means for accepting said first end of said at least one longitudinally extending elongated support member;

at least one second means for accepting said second end of said at least one longitudinally extending elongated support member; and at least one non-elastomeric compressive member connected to adjacent elongated transversely extending, spaced-apart, load bearing members for controlling the spacing between said adjacent load bearing members.

2. The modular expansion joint system of claim 1, wherein each of said plurality of transversely extending, spaced-apart, load bearing members comprise top surfaces and bottom surfaces, and wherein said top surfaces of each of said plurality of transversely extending, spaced-apart, load bearing members are adapted to support vehicular traffic.

3. The modular expansion joint system of claim 1, comprising elastomeric seals extending between adjacent transversely extending, spaced-apart, load bearing members.

4. The modular expansion joint system of claim 1, comprising elastomeric seals extending (i) between adjacent transversely extending, spaced-apart, load bearing members, and (ii) between said transversely extending, spaced-apart, load bearing members and edge sections of said first and said second structural members.

5. The modular expansion joint system of claim 1, wherein said first and second means for accepting the first and second ends of said longitudinally extending elongated support members comprise a structure selected from the group consisting of a box, receptacle, chamber, housing, container, enclosure, channel, track, slot, groove and passage.

6. The modular expansion joint system of claim 1, further comprising means for movably engaging said longitudinally extending, elongated support members with said transversely extending, spaced-apart load bearing members.

7. The modular expansion joint system of claim 6, wherein said means for movably engaging said longitudinally extending further comprises a yoke.

8. The modular expansion joint system of claim 7, wherein said yoke is substantially U-shaped.

9. The modular expansion joint system of claim 7, wherein said yoke comprises spaced-apart yoke side plates and a bent yoke plate spanning the gap between said spaced-apart yoke side plates.

10. The modular expansion joint system of claim 7, wherein said yoke comprises an integral piece comprising spaced-apart yoke side legs and a spanning portion extending between said spaced-apart yoke side legs, and wherein a thickness of the spanning portion is greater than a thickness of the yoke side legs.

11. The modular expansion joint system of claim 7, wherein said yoke comprises first and second spaced-apart yoke side legs, wherein each of said first and second spaced-apart yoke side legs comprise a first leg portion and a second leg portion and a bend region transitioning between said first leg portion and said second leg portion, and plate member connected to said second leg portion of at least one of said first and second spaced-apart yoke side legs.

12. The modular expansion joint system of claim 8, wherein said yoke slidably engages said longitudinally extending, elongated support members with said transversely extending, spaced-apart load bearing members.

13. The modular expansion joint system of claim 8, wherein said yoke comprises bearings to permit longitudinal and vertical movement of said longitudinally extending, elongated support members.

14. The modular expansion joint system of claim 2, further comprising a connection member connected to and extending downwardly from said bottom surfaces of adjacent load bearing members, and wherein said non-elastomeric compressive member is connected to said connection members.

15. The modular expansion joint system of claim 14, wherein a portion of said non-elastomeric compressive member extends substantially horizontally between said connection members.

16. The modular expansion joint system of claim 15, wherein said non-elastomeric compressive member comprises an elongated compression spring.

17. The modular expansion joint system of claim 16, wherein said elongated compression spring comprises a helical compression spring.

18. The modular expansion joint system of claim 17, wherein said helical compression spring comprises a material selected from the group consisting of alloy spring steels, stainless spring steels, carbon spring steels, copper-based steel alloys, and nickel-based steel alloys.

19. The modular expansion joint system of claim 18, further comprising a protective layer positioned about at least a portion of said elongated compression spring.

20. The modular expansion joint system of claim 19, wherein said protective layer comprises a coating, sleeve or wrap.

21. The modular expansion joint system of claim 20, wherein the coating comprises a corrosion-resistant coating.

22. The modular expansion joint system of claim 17, further comprising a first tubular member comprising a first elongated tubular portion at least partially positioned within said first end of said compression spring, wherein said first tubular member comprises opposite first and second ends, an outer wall, and a hollow interior, and a second tubular member comprising a second elongated tubular portion at least partially positioned within said second end of said compression spring, wherein said second tubular member comprises opposite first and second ends, an outer wall, and a hollow interior.

23. The modular expansion joint system of claim 22, wherein said first tubular member further comprises a flange at said first end, wherein the flange comprises opposite facing first and second surfaces and an opening in communication with hollow interior of said first elongated tubular portion, wherein said first elongated tubular portion extends perpendicularly from said second surface of said surface of said flange, and wherein said second tubular member further comprises a flange at said first end, wherein the flange comprises opposite facing first and second surfaces and an opening in communication with hollow interior of said second elongated tubular portion, wherein first elongated tubular portion extends perpendicularly from said second surface of said surface of said flange.

24. The modular expansion joint system of claim 22, wherein a flange of each of said first and second tubular members is circular with an outer circumference, wherein, a cross-section of taken along a short axis of said hollow interior of said first and second tubular portions of first and second said tubular members, is circular with a circumference concentric with said outer circumference of said flange of each of said first and second tubular members.

25. The modular expansion joint system of claim 24, wherein the circumference of an opening of said flange of each of said first and second tubular members is substantially coextensive with the circumference of said opening of each of said first and second tubular portions of each of said first and second tubular members.

26. The modular expansion joint system of claim 23, further comprising first and second clip members, wherein each of first and second clip members comprise a base having a bend portion and a spaced apart protrusion extending away from said base, wherein the bend portion and the protrusion extend away from the base in the same direction and in the same vertical plane, and wherein the bend portion terminates into a tab.

27. The modular expansion joint system of claim 26, wherein said bend portion of said first and second clips includes a recessed portion adjacent to said tab.

28. The modular expansion joint system of claim 27, wherein said tab includes a thickened portion and an abutment wall, wherein said abutment wall is adjacent said recessed portion of said bend portion of said first and second clips.

29. The modular expansion joint system of claim 26, wherein said bend portion and said protrusion are spaced-apart long a length of said base in a substantially parallel manner.

30. The modular expansion joint system of claim 14, wherein each of said connection members comprise an opening, wherein protrusions of a first and second clip member pass through said opening of said connection members and the opening of a flange of each of a first and second tubular members, and are inserted into each of a first and second tubular portions of each of said first and second tubular members.

* * * * *